United States Patent [19]

Smilg et al.

[11] 4,058,935

[45] Nov. 22, 1977

[54] VIBRATORY APPARATUS WITH ELECTROMAGNET CONTROL SYSTEM

[75] Inventors: Benjamin Smilg; Milton S. Isaacson, both of Dayton, Ohio

[73] Assignee: Vibrodyne, Inc., Dayton, Ohio

[21] Appl. No.: 626,626

[22] Filed: Oct. 29, 1975

[51] Int. Cl.[2] ..... B24B 31/06

[52] U.S. Cl. ..... 51/163.1

[58] Field of Search ..... 318/37; 51/163.1

[56] References Cited

U.S. PATENT DOCUMENTS

| | | | |
|---|---|---|---|
| 1,779,454 | 10/1930 | Traylor | 318/37 |
| 3,413,764 | 12/1968 | Kunkle | 51/163.1 |
| 3,456,395 | 7/1969 | Parrella | 51/165.77 |
| 3,643,384 | 2/1972 | Isaacson | 51/163.1 |

*Primary Examiner*—Harold D. Whitehead

*Attorney, Agent, or Firm*—Jacox & Meckstroth

[57] ABSTRACT

An elongated tub-like container is supported for vibration by a set of springs mounted on a frame, and a plurality of sets of opposing electromagnets are positioned on opposite sides of corresponding armatures connected to the container for vibrating the container. A regulator is connected to vary the electric power supplied to only one set or a portion of the electromagnets while the remaining electromagnets are either energized or not energized depending on the level of power required for vibrating the container. In the embodiment illustrated with three sets of opposing electromagnets, the center set of electromagnets is controlled by a voltage regulator, and the outer sets of electromagnets are selectively energized to provide for obtaining any desired power between zero and the maximum in three stages with a voltage regulator of minimum size.

5 Claims, 4 Drawing Figures

FIG-1
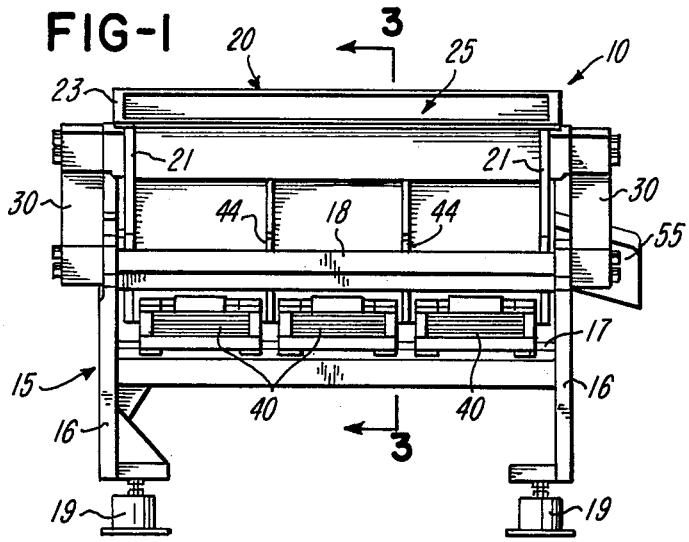
FIG-2
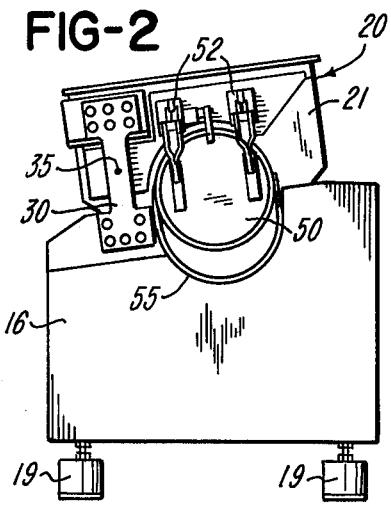
FIG-3
FIG-4
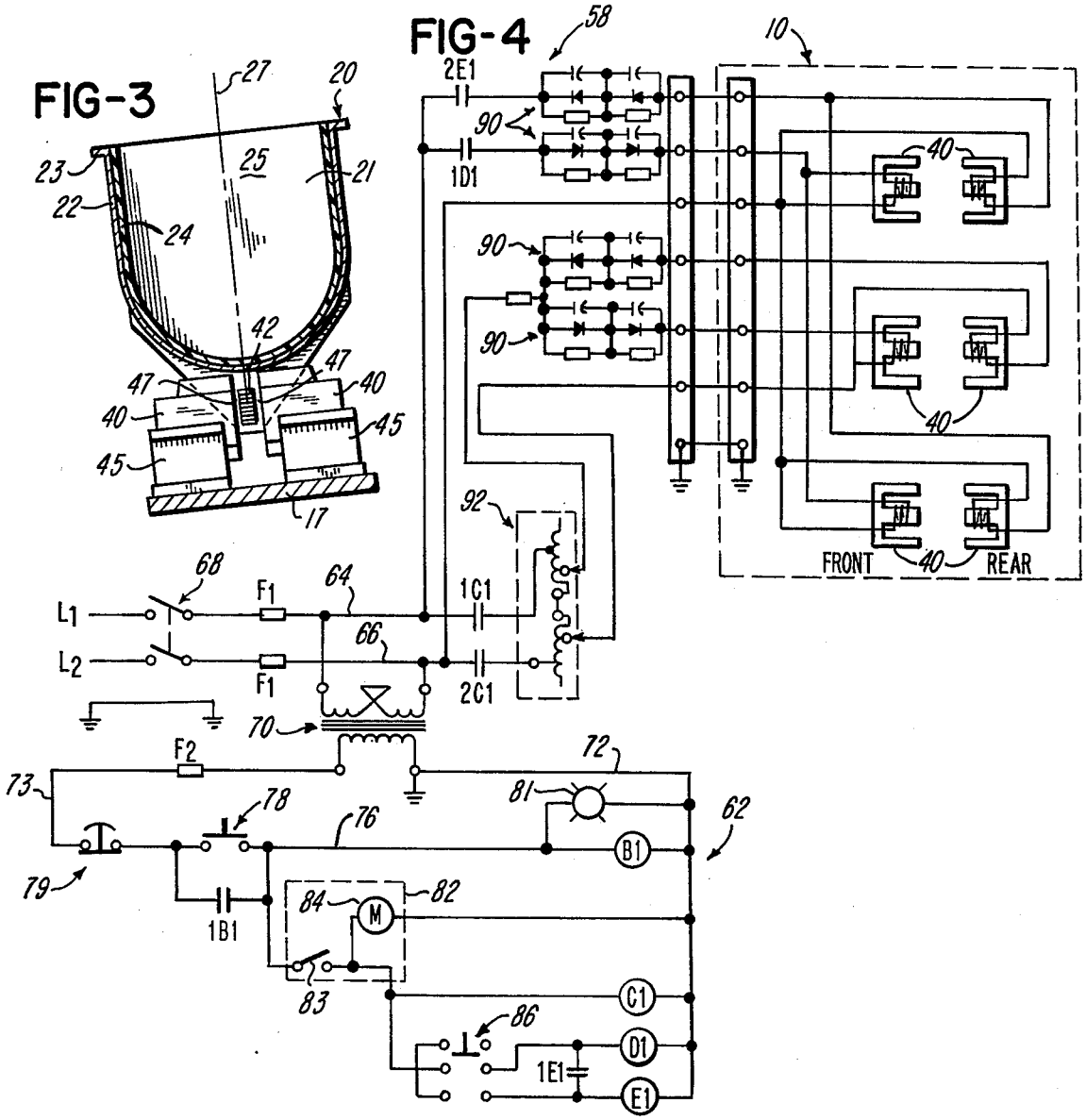

VIBRATORY APPARATUS WITH ELECTROMAGNET CONTROL SYSTEM

BACKGROUND OF THE INVENTION

In a vibratory machine or apparatus such as disclosed, for example, in Isaacson et al U.S. Pat. Nos. 3,173,664 and 3,643,384, an elongated tube or container having a U-shaped vertical cross-sectional configuration, is supported by a set of spring beams for oscillatory movement on an effective pivot axis. One or more sets of opposing electromagnets are supported below the container in opposing relation and on opposite sides of corresponding armatures which are rigidly connected to the container. When the electromagnets are energized, the container oscillates and produces orbital movement of a workload within the container. Usually, the work load consists of a predetermined weight of treating media and a batch of parts to be treated, for example, by a deburring, polishing or descaling operation.

One or more sets of opposing electromagnets are also used for vibrating or oscillating other forms of vibratory members such as a vibratory screen which operates to separate the parts from the media after the parts have been treated. In relatively small vibratory treating machines, only one set of opposing electromagnets may be required to produce the desired amplitude of vibration or oscillation of the container and work load. However, with larger machines, it is common to employ two or more sets of opposing electromagnets in order to obtain the desired amplitude of vibration with the larger and heavier work load of parts and media.

One important advantage of using electromagnets as provided by the fact that the power output of the electromagnets may be varied in infinitely small increments by varying the voltage of the electrical power supplied to the electromagnets. Thus the rate at which the parts are treated by the treating media and the intensity of the treatment, may be varied or precisely controlled by changing the voltage of the power supplied to the electromagnets. The change in voltage is commonly provided by means of a voltage regulator of the transformer type such as marketed under the trademark Variac.

The voltage regulator is connected to vary the voltage of the power supplied to all of the electromagnets in unison and is adjusted according to the type of treating media, the form of parts to be treated, the desired treating time, etc. It has been found that the voltage regulators which are used in connection with the larger vibratory machines, have become more and more expensive to construct or purchase and also have substantial mass or weight which significantly adds to the shipping cost of the vibratory machine and its electrical control system. Also large voltage regulators are subject to large energy losses when passing power through the large windings.

SUMMARY OF THE INVENTION

The present invention is directed to a vibratory machine or apparatus having a component or container which is vibrated by a plurality of sets of opposing electromagnets and which incorporates an improved and simplified system for variably controlling the vibratory power exerted by the electromagnets on the component or container according to the type and weight of the work load supported by the component or container. The control system of the invention provides for significantly decreasing the cost and weight of the control system in addition to the floor space required by the control system and improving the electrical power efficiency. In addition, the control system of the invention provides for varying the vibratory power applied to one portion of a vibratory container with respect to other portions of the container to compensate for differential flexing of the container and its mass or loading distribution. This will minimize migration of parts within the container, especially when the density of the parts is substantially greater than the density of the treating media.

In accordance with the illustrated embodiment of the invention, the above desirable features are provided by a vibratory machine having a plurality of sets of opposing electromagnets and wherein the voltage of the power supplied only to the center set of electromagnets is variably controlled by a voltage regulator. The electrical power supplied to the end sets of electromagnets is selected between on and off positions to bypass the voltage regulator so that the power applied by the electromagnets to vibrate the container is controllable in small increments through a plurality of levels or ranges. It is to be understood that the control system of the invention may be used for controlling the vibration of different forms of vibratory members such as a vibratory screen which is used for separating the parts from the treating media after the parts are treated.

Other features and advantages of the invention will be apparent from the following description, the accompanying drawings and the appended claims.

BRIEF DESCRIPTION OF THE DRAWINGS

FIG. 1 is a side elevational view of vibratory apparatus which incorporates a control system construction in accordance with the invention;

FIG. 2 is an end view of the vibratory apparatus shown in FIG. 1;

FIG. 3 is a section taken generally on the line 3—3 of FIG. 1 and showing the vibratory container and a set of opposing electromagnets used for vibrating the container; and FIG. 4 is a schematic electrical diagram of the control system for actuating the opposing sets of electromagnets shown in FIGS. 1 and 3.

DESCRIPTION OF THE ILLUSTRATED EMBODIMENT

The vibratory machine or apparatus 10 shown in the drawing generally includes an elongated base frame 15 having parallel spaced vertical end walls 16 rigidly connected by a set of longitudinally extending members including a bottom frame member or plate 17 and side frame members 18. The frame 15 is mounted on resilient shock absorbing pads or supports 19 located at the corners of the frame. An elongated trough-like tub or container 20 is positioned between the end walls 16 of the frame 15 and includes parallel spaced vertical end walls 21 which are rigidly connected by an intermediate wall 22 having a U-shaped cross-sectional configuration. The container 20 has an outwardly projecting upper peripheral flange 23, and the metal walls 21 and 22 are covered with a durable polyurethane liner 24.

The lined container walls 21 and 22 define an open top chamber 25 having a rectangular horizontal configuration and a U-shaped vertical configuration. The chamber 25 is adapted to receive a work load, for example, a media of steel balls or ceramic chips or other abrasive materials and a batch of parts which are to be surface finished such as by a deburring, polishing or descaling operation. The container 20 is positioned so that a longitudinal plane 27 extending through the center of symmetry of the chamber 25, is slightly inclined from a vertical plane.

The container 20 is supported on the front side of the center plane 27 by a pair of I-shaped spring beams 30 which connect the end walls 21 of the container to the end walls 16 of the frame 15. The spring beams 30 establish an effective pivot axis 35 for the container 20 and provide the container 20 with a predetermined resonant frequency of oscillation. This resonant frequency is generally or slightly above 3600 cycles per minute when the apparatus is to be operated from a 60 cycle power supply so that after a work load is placed within the container chamber 25, the resonant frequency of the system including the container, work load, and the spring beams, is substantially 3600 cycles per minute.

The container 20 is vibrated or oscillated by power operated means including a plurality of longitudinally spaced sets of electromagnets 40. The electromagnets 40 of each set are arranged in opposing relation on opposite sides of a corresponding bar-like armature 42. The ends of each armature 42 are rigidly connected to parallel spaced plates 44 which are rigidly secured to the intermediate wall 22 of the container 20. Each electromagnet 40 is mounted on a corresponding support pad or bracket 45 which is slidably supported by the bottom plate 17 and is laterally adjustable by a set of screws (not shown). Each electromagnet 40 is initially adjusted with a normal weight work load within the container to form a predetermined substantially uniform gap 47 between each armature and the corresponding set of electromagnets 40 according to the desired amplitude of oscillation.

In reference to FIG. 1, the right end wall 21 of the container 20 is provided with a circular discharge outlet (not shown) which is adapted to be closed by the frustoconical portion of a removable closure member or door 50. The door 50 is locked in its closed position by a pair of lever actuated, over-center latching devices 52 which are movable between retracted or released positions and locked positions (FIG. 2). An inclined trough-like chute 55 is also secured to the right end wall 21 directly under the outlet for directing each work load of parts and media onto a vibratory separating screen after a batch of parts have been treated for a predetermined length of time.

In accordance with the present invention, the plural sets of electromagnets 40 are operated through a control system (FIG. 4) which includes a high voltage circuit 58 and a low votage circuit 62. The high voltage circuit 58 receives its electrical power from lines L1 and L2 which are connected to a high voltage power source such as, for example, a 60 Hz., single phase power supply of 440 volts. The power supply lines L1 and L2 are connected to corresponding lines or wire conductors 64 and 66 through a main control switch 68 and corresponding fuses F1.

The low voltage control circuit 62 receives a 120 volt AC power through a transformer 70 having its primary coil connected to the power supply conductor 64 and 66. The secondary coil of the transformer 70 supplies power to power lines or conductors 72 and 73, and line 73 is provided with a fuse F2. A relay coil B1 is connected by a line 76 to the lines 72 and 73 through a momentary normally open push button start switch 78 and a normally closed push button emergency stop switch 79. A pilot light 81 is connected in parallel with the relay coil B1 which has normally open contacts 1B1 connected in parallel with the push button start switch 78.

A manually adjustable timer 82 includes a switch 83 which is actuated by a cam driven by a timer motor 84 connected in series with the switch 83 across the lines 72 and 76. The timer 82 is set according to the desired time period for treating a batch of parts within the container 20. The timer switch 83 also controls the power supply to a relay coil C1 and to another set of relay coils D1 and E1 through a manually actuated three position power control switch 86.

When the power control switch 86 is in its first or open position, only the relay coil C1 is energized through the timer switch 83. When the power control switch 86 is in its second or center position, the relay coil D1 is also energized simultaneously with the relay coil C1. When the switch 86 is in its third or high power position, relay coil E1 is energized simultaneously by the closing of normally open contacts 1E1.

As indicated above, when control switch 86 is positioned in its first or open position, and relay coil C1 is energized by setting the timer to close switch 83 and then momentarily depressing switch 78 to energize relay B1 and close contacts 1B1, the normally open relay contacts 1C1 and 2C1 close so that high voltage power is supplied from the lines or conductors 64 and 66 to only the center set of electromagnets 40 through a set of rectifiers 90 and a voltage regulator 92, preferably of the transformer type such a sold under the trademark Variac. Thus the power supply for vibrating or oscillating the container 20 is produced only from the center set of electromagnets 40, and this power is adjustable from zero to one-hundred percent of the power of the two magnets by manually adjusting the voltage regulator 92.

When the control switch 86 is positioned in its center or medium power position, the relay coil D1 is energized along with relay coil C1 so that the normally open relay contacts 1D1 close along with relay contacts 1C1 and 2C1. Since the corresponding front and rear electromagnets of the end sets of electromagnets are connected in parallel, the energizing of relay contacts 1D1 is effective to energize the front end pair of electromagnets 40 on opposite sides of the center set of electromagnets. Another rectifier 90 is connected between the relay contacts 1D1 and the front end pair of electromagnets 40 for converting the AC power supply into DC power usuable by the electromagnets. Thus when the switch 86 is in its medium position, the container 12 is vibrated or oscillated in response to the power supplied to four electromagnets, including the center pair of opposing electromagnets with voltage control and one front electromagnet corresponding to each end portion of the container 20 and operating at full power only.

When the control switch 86 is set in its third or high power position, all three relay coils C1, D1 and E1 are energized. The energizing of relay coil E1 is effective to close the normally open relay contacts 2E1 so that the high voltage power is also supplied through a corresponding rectifier 90 to the rear pair of end electromagnets 40 corresponding to the opposite end portions of the container 20. Thus when switch 86 is in its high-power position, all six electromagnets 40 are energized, but only the center set of opposing electromagnets are variably controllable by the voltage regulator 92.

It is thus apparent from the drawing and the above description that a vibratory apparatus including an electromagnet control system constructed in accordance with the present invention, provide desirable features and advantages. For example, one important feature is provided by the fact that only a relatively small voltage regulator 92 is used to provide for variably controlling the power supplied by the electromagnets from zero power to the maximum power of all six of the electromagnets shown. That is, when the switch 86 is in its low-power position and only the center pair of electromagnets is energized, the power supplied to vibrate the container 20 may be regulated within a first range between zero power and 33⅓% of the total power of the six electromagnets. In the medium-power position of the switch 86, the voltage regulator 92 provides for infinitely varying the power supplied to the container 20 within a second range between 33⅓% and 66⅔% of the power of the six magnets. In the high-power position of the switch 86, the voltage regulator 92 provides for varying the power supplied to vibrate the container 20 within a third range of 66⅔% and 100% of the power of the six magnets.

Thus the power to vibrate the container 20 may be varied between 0 and 100% of the power available from the six electromagnets according to the selection of the control switch 86 and the adjustment of the voltage regulator 92. The incorporation of the relatively small voltage regulator 92 for controlling the full range of power supplied to the container 20, is highly desirable in that the regulator 92 is significantly less costly and has substantially less mass than a voltage regulator which would be capable of varying the power supplied to all of the electromagnets simultaneously. Furthermore, the control system of the invention provides for using one size voltage regulator 92 with various sizes of vibratory machines, thereby providing for a significant reduction in the number of voltage regulators which must be maintained in inventory.

As additional advantages, the control system of the invention provides for extremely fine adjustment or tuning of the power supply to vibrate the container 20 and also provides for selectively controlling the electromagnets in a manner which produces uniform vibration or oscillation of the container 20. For example, it is frequently desirable to apply greater energy or power to the electromagnets corresponding to the center portion of the container 20 in order to force the center portion of the container 20 to vibrate substantially at the same amplitude as the more rigid end portions of the container. Thus the control system of the invention provides for adding more power to the center set of opposing electromagnets 40 in order to minimize migration of heavy parts of the work load within the container 20 and thereby obtains a more uniform distribution of the parts especially when the density of the parts is substantially greater than the density of the media.

While the control system of the invention is illustrated in connection with three sets of electromagnets arranged for vibrating or oscillating an elongated tub or container 20, it is apparent that the control system may be used for controlling the power supply to any number of electromagnets which are positioned for vibrating a tub or container or other vibratory member. It is also apparent that the relatively smaller voltage regulator 92 may be connected in a manner as described above to control various different combinations of electromagnets according to the desired manner of applying the power to the vibratory container or member. The control system of the invention may also be produced with all solid state components.

While the form of vibratory apparatus herein described constitutes a preferred embodiment of the invention, it is to be understood that the invention is not limited to this precise form of apparatus, and that changes may be made therein without departing from the scope and spirit of the invention as defined in the appended claims.

We claim:

1. In vibratory apparatus including a frame, an elongated container adapted to receive a load of media and parts to be treated, spring means mounted on said frame and supporting said container for vibration, power operated means cooperating with said spring means for vibrating said container to produce orbital movement of the load within said container, said power operated means including a plurality of electromagnets spaced along the length of said container, and an armature member connected to said container and disposed adjacent each of said electromagnets, an improved system for controlling said electromagnets from an electrical power supply, comprising first control means consisting of an on-off switch for simultaneously connecting a first set of at least two longitudinally spaced said electromagnets directly to said electrical power supply to provide for only selecting either a non-variable predetermined power or zero power to said electromagnets, second control means including a variable power controller for simultaneously connecting a second set of at least two said electromagnets to said electrical power supply and providing for variably adjusting the electrical power supplied to said second set of electromagnets between zero and maximum power of said power controller, each said set of electromagnets being disposed substantially symmetrically with respect to a center plane extending laterally across said container, and said second set of electromagnets is arranged between said electromagnets of said first set.

2. Vibratory apparatus as defined in claim 1 wherein said controlling system includes a high voltage circuit and a low voltage circuit connected by a transformer, means in said high voltage circuit for selectively connecting high voltage electrical power to said first set of electromagnets, and means in said low voltage circuit for controlling the actuation of said connecting means in said high voltage circuit.

3. Vibratory apparatus as defined in claim 1 wherein said power operated means comprise three pairs of opposing electromagnets, and only one pair of said electromagnets is connected to the power supply through said variable power controller.

4. In vibratory apparatus including a frame, an elongated container adapted to receive a load of media and parts to be treated, spring means mounted on said frame and supporting said container for vibration, power operated means cooperating with said spring means for vibrating said container to produce orbital movement of the load within said container, said power operated means including a plurality of electromagnets spaced along the length of said container, and an armature member connected to said container and disposed adjacent each of said electromagnets, an improved system for controlling said electromagnets from an electrical power supply, comprising first control means consisting of an on-off switch for simultaneously connecting a first set of at least two longitudinally spaced said electromagnets directly to said electrical power supply to provide for only selecting either a non-variable predetermined power or zero power to said electromagnets, second control means including a variable power controller for simultaneously connecting a second set of at least two electromagnets to said electrical power supply and providing for variably adjusting the electrical power supplied to said second set of electromagnets between zero and maximum power of said power controller, each said set of electromagnets being disposed substantially symmetrically with respect to a center plane extending laterally across said container, said second set of electromagnets is arranged between said electromagnets of said first set, and said first control means and said second control means cooperate to provide for variably adjusting the total power supplied to said first and second sets of electromagnets between zero and full power for selecting any desired power between zero and full power.

5. In vibratory apparatus including a frame, an elongated container adapted to receive a load of media and parts to be treated, spring means mounted on said frame and supporting said container for vibration, power operated means cooperating with said spring means for vibrating said container to produce orbital movement of the load within said container, said power operated means including a plurality of at least three electromagnets spaced along the length of said container with an intermediate electromagnet disposed longitudinally between two outer electromagnets disposed substantially symmetrically with respect to a center plane extending laterally across said container, and an armature member connected to said container and disposed adjacent each of said electromagnets, an improved system for controlling said electromagnets from an electrical power supply, comprising first control means consisting of an on-off switch for simultaneously connecting the longitudinally spaced said outer electromagnets directly to said electrical power supply to provide for only selecting either a nonvariable predetermined power or zero power to said outer electromagnets, and second control means including a variable power controller connecting said intermediate electromagnet to said electrical power supply and providing for variably adjusting the electrical power supplied to said intermediate electromagnet between zero and maximum power of said power controller.

* * * * *